US005640864A

United States Patent [19]

Miyamoto

[11] Patent Number: 5,640,864

[45] Date of Patent: Jun. 24, 1997

[54] CYLINDER LOCK RESISTIBLE AGAINST BREAKING

[75] Inventor: Keiichi Miyamoto, Yokohama, Japan

[73] Assignee: Alpha Corporation, Yokohama, Japan

[21] Appl. No.: 364,763

[22] Filed: Dec. 27, 1994

[30] Foreign Application Priority Data

Dec. 27, 1993 [JP] Japan ..... 5-333088
Apr. 28, 1994 [JP] Japan ..... 6-092735

[51] Int. Cl.[6] ..... E05B 9/10

[52] U.S. Cl. ..... 70/379 R; 70/360; 70/380

[58] Field of Search ..... 70/356, 367, 369, 70/379 R, 380, 492, 379 A, 381, 222, 223, 421, 493, DIG. 36, 472, 422, 419, 360

[56] References Cited

U.S. PATENT DOCUMENTS 3,287,944 11/1966 Crumb ..... 70/419
5,265,453 11/1993 Korii et al. ..... 70/379 R
5,285,667 2/1994 Fukasawa et al. ..... 70/379 R

FOREIGN PATENT DOCUMENTS 2228523 8/1990 United Kingdom ..... 70/379 R

*Primary Examiner*—Steven N. Meyers
*Assistant Examiner*—Tu Yet-Phuong Pham
*Attorney, Agent, or Firm*—Bachman & LaPointe, P.C.

[57] ABSTRACT

The cylinder lock according to the present invention comprises a latch 19 movably disposed between the joint position connecting the key cylinder 16 and a driver 18 and the release position disengaging the key cylinder 16 and a driver 18; and a clutch 20 for transferring the latch 19 to the release position when a sleeve 13 rotates relatively to a housing 11 with an improper key. When a proper key is inserted into the key cylinder 16, it can be rotated without rotation of the sleeve 13 so that the driver 18 can be rotated to the locked or unlocked position through the latch 19 which drivingly connects the key cylinder 16 and the driver 18. When an improper key is inserted into the key cylinder 16 and rotated, the sleeve 13 is rotated with the key cylinder 16 through tumblers 17 so that radial movement of the clutch 20 disengages the latch 19 and driver 18, thereby preventing unauthorized unlocking of the cylinder lock 10 without rotation of the driver 18.

15 Claims, 14 Drawing Sheets

CYLINDER LOCK RESISTIBLE AGAINST BREAKING

FIELD OF THE INVENTION

The present invention relates, in general, to a lock device and more particularly, to a cylinder lock highly resistible against its destruction.

PRIOR ART

A conventional cylinder lock has a key cylinder with tumblers disposed within slots formed in the key cylinder so that these tumblers can be engaged with or disengaged from a groove formed in a casing of the lock. The key cylinder may be rotated to a locked or unlocked position by using a proper key inserted into a key hole of the key cylinder.

In the conventional cylinder lock which prevents rotation of the key cylinder by engagement of the tumblers with the groove of the casing in the locked position, unauthorized unlocking may be carried out by destroying the tumblers. For example, U.S. Pat. No. 4,903,512 discloses a free-turn type cylinder lock device with a key cylinder which is capable of freely rotating when a rotative force is applied to the key cylinder for unauthorized unlocking. The cylinder lock of this type includes a sleeve rotatably disposed in the casing of the lock and a key cylinder rotatably disposed in the sleeve.

When a proper key is inserted into the key hole of the key cylinder, the tumblers are radially inwardly moved in the slots of the key cylinder away from the groove formed in the sleeve so that the key cylinder can be rotated in and relative to the sleeve, and simultaneously a slidable ring engages with a driver to operate the lock device. When an improper key is inserted into the key cylinder they are rotated together with the sleeve due to engagement of the tumblers with the sleeve so that the driver can not be rotated to prevent operation of the lock device. In this way, the free-turn type cylinder locks are highly resistible against its destruction because no rotational force can be applied to the tumblers due to free rotation of the key cylinder when an improper key or any tool is inserted into the key hole of the key cylinder for the purpose of destruction of the lock.

However, the lock disclosed in U.S. Pat. No. 4,903,512 has the disadvantage that the key cylinder can not be rotated smoothly once an improper key is inserted and rotated. Specifically, a torsion coil spring is provided between the front plate and the key cylinder within the lock in order to automatically return the rotated key cylinder to its initial position. If an improper key is inserted into the key cylinder and rotated, the sleeve and the key cylinder are freely rotated together, then the torsion coil spring produces a resisting force. However, if they are rotated over a predetermined angle, the torsion coil spring restricts rotation of the key cylinder. This might pose a possibility that the torsion coil spring may be broken or damaged. However, without the torsion coil spring, the key cylinder will not be automatically returned to its initial position when the key cylinder is rotated with the proper key, thus preventing smooth locking or unlocking operation. In the lock device noted in the foregoing patent, the spring may be frozen in very cold areas during use because the torsion spring is disposed at the front portion of the lock device.

In addition, the conventional free-turn type cylinder lock needs rotation of the key cylinder by a certain amount of angles to connect the key cylinder with a lever when a proper key is used. The lever is not rotated to the locked or unlocked position at all during this initial rotation of the key which requires a wider an range for rotation in order to rotate the lever to the locked or unlocked position because the cylinder must be rotated through an elongated angular path for connection of the key cylinder to the lever. Moreover, the connecting mechanism of the key cylinder to the lever needs sliding parts which may produce inconvenient wear during use for long time. Also, there is another defect that the cylinder lock can not be manufactured in short size because the sliding parts move along their axial strokes.

Accordingly, an object of the present invention is to provide a cylinder lock which has excellent durability and operability. Another object of the present invention is to provide a cylinder lock of the free turn type strongly resistible against its destruction with the key cylinder which can rotate freely when an improper key is used. Still another object of the invention is to provide a cylinder lock of free turn type having its shorter axial length. A further object of the present invention is to provide a cylinder lock of free turn type with the key cylinder which can be directly connected and rotated with driving means without angular clearance when a proper key is used. A still further object of the invention is to provide a cylinder lock having less number of sliding parts with shorter whole length, reducing breakdown and prolonging its service life without axially moving parts when a proper key is used. A further object of the invention is to provide a cylinder lock without axially sliding parts which may produce inconvenient wear during use for long time.

SUMMERY OF THE INVENTION

The cylinder lock according to the present invention comprises a housing having a first hole; a sleeve rotatably disposed within the first hole of the housing and having a second hole and a notch; a key cylinder rotatably disposed within the second hole of the sleeve; tumblers slidably disposed in the key cylinder for engagement with and disengagement from the notch of the sleeve; driving means provided relatively rotatable to the housing;Sincerely; latch means movable between the joint position for connecting the key cylinder and the driving means and the release position for disengaging the key cylinder and driving means; clutch means radially movably disposed in the sleeve for conveying the latch means to the release position when the sleeve is moved relative to the housing; and a clutch spring for resiliently urging the clutch means toward the housing.

The housing is formed with a groove which receives a convexity formed in the clutch means. The convexity of the clutch means is moved away from the groove of the housing for disengaging the latch means and the driving means with movement of the clutch means when the sleeve is rotated relative to the housing.

The latch means is generally formed into L-shape which comprises a spring holder and a connector. The spring holder is urged toward the driving means by a latch spring disposed in the key cylinder. The clutch means has a protrusion which axially extends not to contact the latch means when a proper key is inserted into the key hole of the key cylinder. The protrusion of the clutch means contacts the latch means when an improper key is inserted into the key hole of the key cylinder. The latch means includes a connecting portion disposed within a radial slit formed in the key cylinder for integral rotation; a column portion coupled with the connecting portion for engagement with the clutch means; and a pair of lugs axially extending from the column portion. The driving means includes a shaft portion; a flange portion formed at an end of the shaft portion; and a pair of arcuate portions axially projecting with a gap formed between the arcuate portions. The lugs are engaged with and disengaged from the arcuate portions with radial movement of the clutch means.

The clutch means has a radially extending projection which may be engaged with the key cylinder when an improper key is used. The convexity of the clutch means is received in the groove of the housing in position when the key cylinder is rotated later with a proper key. The groove of the housing axially extends and reaches an opening formed in the housing to drain water entering the housing through the groove and the opening.

In an embodiment of the present invention, locking means is provided having a protrusion which can be engaged with a depression formed in the housing. The locking means is movable between the latched position wherein the protrusion is engaged with the depression of the housing and the unlatched position wherein the protrusion is disengaged from the depression of the housing. The locking means is moved between the latched and unlatched positions in response to movement of the latch means between the joint and release positions. A locking spring is provided to resiliently urge the locking means toward the latched position. The locking means is retained in the unlatched position against elastic force of the locking spring by the latch means in the joint position. The locking means is moved to the latched position by elastic force of the locking spring. The locking means has a hook portion which is in contact with a lug of the latch means. The latch spring produces its resilient force stronger than that of the locking spring. The latch means is urged toward the driving means by the latch spring positioned within the key cylinder.

The locking means is slidably disposed within a slit formed in the driving means. The locking means in the latched position secures the drive means to the housing when the latch means is moved by the clutch means, thereby causing rotation of the key cylinder, sleeve and latch means without rotation of the driving means. The latch means is urged by the latch spring positioned within the key cylinder toward the driving means. The clutch means has a projection which axially extends to contact with the latch means when the key cylinder is rotated with an improper key. The locking means is in driving connection with the latch means.

The clutch means has a radially extending projection which may be engaged with the key cylinder, when an improper key is used. The convexity of the clutch means is received in the groove of the housing in position when the key cylinder is rotated later with a proper key. The locking means has a connecting hole for receiving a lug of the latch means. The lug of the latch means and connecting hole of the locking means are positioned in a central line of the key cylinder so that the lug can be relatively rotated within the connecting hole when the locking means is in the latched position.

While a key is not inserted into the key cylinder, the key cylinder and the sleeve are engaged with each other by the tumblers and the latch means is in the joint position to connect the key cylinder and the driver means. In this condition, when a proper key is inserted into the key cylinder, the tumblers are moved to the retracted position within the key cylinder to release the engagement between the key cylinder and the sleeve. When the proper key is rotated, the key cylinder is rotated with the key in the condition that the sleeve is fixed to the housing by the clutch means. Simultaneously, the driving means is rotated to the locked or unlocked position with rotation of the key cylinder, since the driving means is connected with the key cylinder through the latch means. After the rotative force is removed from the key, the driving means and the key cylinder are automatically returned to the initial position by resilient force of a return spring.

The key cylinder into which an improper key is inserted is engaged with the sleeve by the tumblers so that the cylinder is rotated together with the sleeve when the improper key is rotated. At this time, the clutch means is radially moved to release the driving connection between the latch means and the driving means, thus preventing rotation of the driver means to the locked or unlocked position.

In an embodiment of the instant invention, the locking means is radially moved from the unlatched position to the latched position so that the protrusion of the locking means comes into engagement with the depression of the housing to secure the driving means to the housing, thus preventing the driving means to the lock or unlocked position. In this way, the driving means is drivingly connected with the key cylinder in use of the proper key so that the key cylinder directly rotates the driving means without angular clearance. Also, axial whole length of the cylinder lock is not substantially increased in comparing prior art cylinder locks of other types since the latch means, clutch means and locking means are movable only in the radial direction. Accordingly, the cylinder lock of the present invention is manufactured in substantially same size as those of prior art locks.

DETAILED DESCRIPTION OF THE INVENTION

Figure 1:
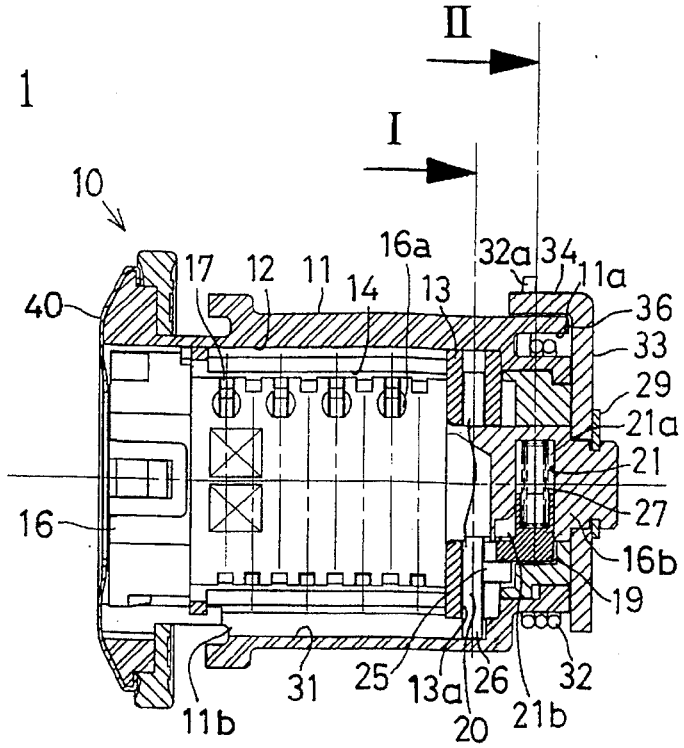
FIG. 1 is a longitudinal section view of the cylinder lock according to the present invention.
Figure 2:
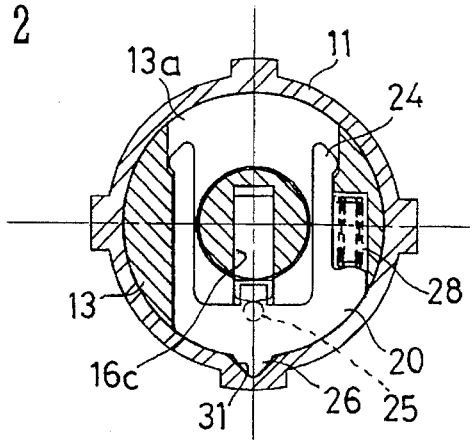
FIG. 2 is a cross-sectional view taken along line I—I of FIG. 1.

Referring to FIG. 1 through 32, four embodiments of the cylinder lock according to the present invention will be described as follows.

The cylinder lock 10 according to the present invention comprises a housing 11 provided with a first hole 12 and a sleeve 13 rotatably disposed within the first hole 12 of the housing 11. The sleeve 13 has a second hole 14 for rotatably receiving a key cylinder 18 and a slot 13*a* at the rear end for radially slidably receiving clutch means 20. Tumblers 17 are slidably disposed in slits 16*a* of the key cylinder 18 so that they are engaged with and disengaged from notch 15 of the sleeve 13. The notch 15 is communicated to the second hole 14 of the sleeve 13. Driving means 18 is rotatably disposed within the housing 11, and latch means 19 is disposed in a latch hole 21 formed in a cylindrical portion 16*b* of the key cylinder 16 so that the latch means 19 can be moved between a joint position (FIGS. 1 and 3) for connecting the key cylinder 16 with the driving means 18 and a release position (FIGS. 5 and 7) for disengaging the key cylinder 16 and the driving means 18. Clutch means 20 which is slidably located within the slot 13*a* of the sleeve 13 may contact and carry the latch means 19 to the release position when the sleeve 13 is rotated in the housing 11 with an improper key.

A cap 40 is attached to the front end of the housing 11 to cover a front surface of the key cylinder 16. An E-shaped ring 29 is attached to the rear end of the key cylinder 16 to prevent detachment of the lever 33 from the key cylinder 16 and detachment of the key cylinder 18 from the first hole 12 of the housing 11.

Figure 3:
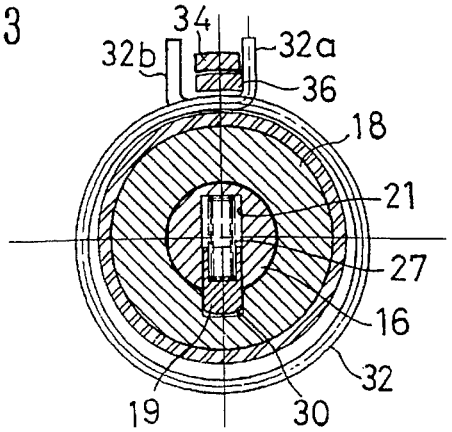
FIG. 3 is a cross-sectional view taken along line II—II of FIG. 1.
Figure 4:
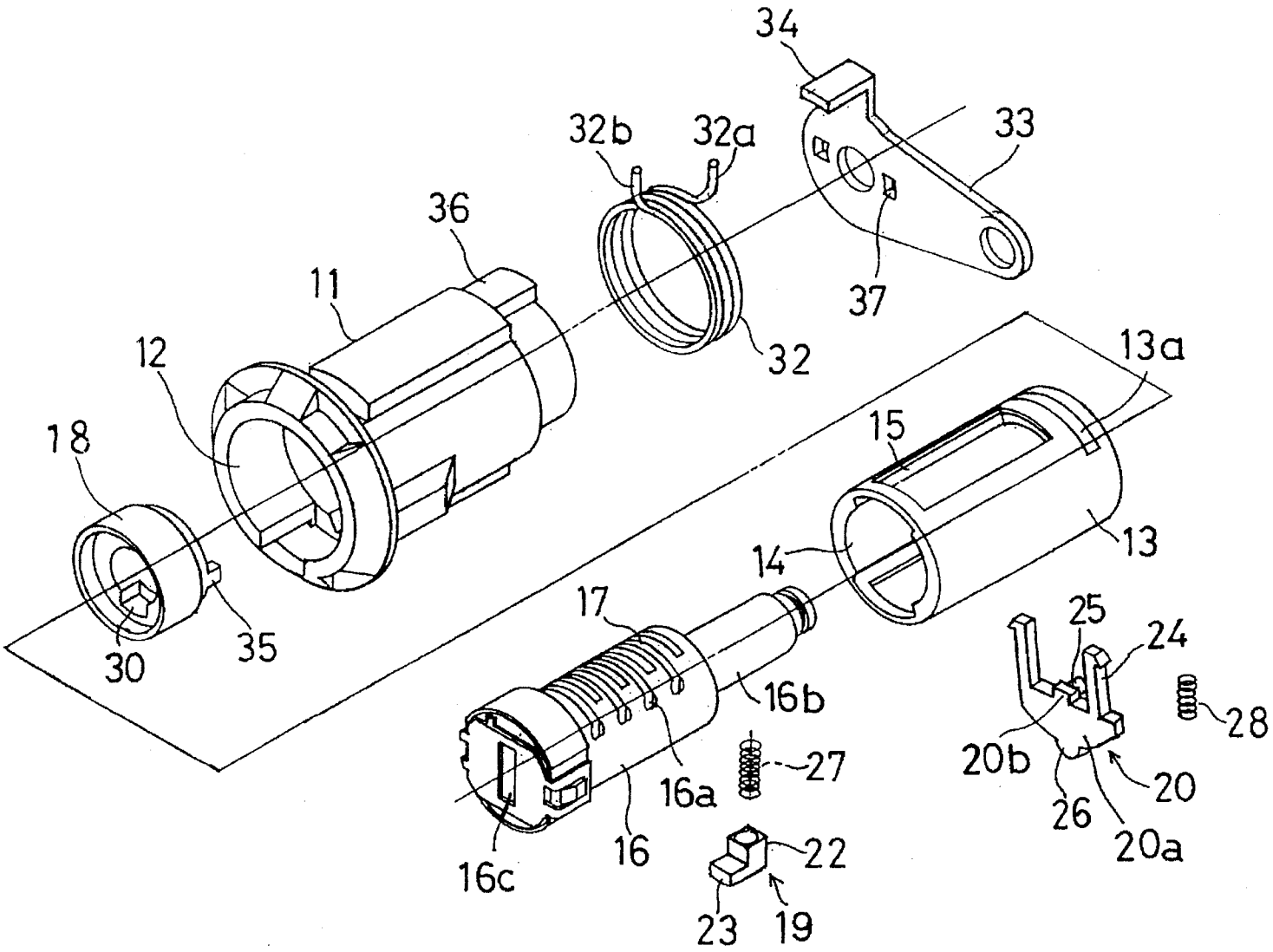
FIG. 4 is an exploded view of the cylinder lock according to the present invention shown in FIG. 1.

As shown in FIG. 1, the latch means 19 and a latch spring 27 are disposed within a latch hole 21 radially formed in the key cylinder 16 so that the latch means 19 is always resiliently urged outwardly in the radial direction by elastic force of the latch spring 27. The latch means 19 is generally formed into L-shape which comprises a spring holder 22 axially extending and a connector 23 radially extending. Formed in the key cylinder 16 is a latch hole 21 which has a deep cylindrical hole 21*a* for receiving the latch spring 27, and an enlarged hole 21*b* for receiving the latch means 19. As shown in FIG. 3, the spring holder 22 of the latch means 19 is disposed in the latch hole 21. When the latch means 19 is in the joint position, the connector 23 of the latch means 19 is engaged with a recess 30 formed in the driving means 18, protruding from the latch hole 21 to drivingly connect the key cylinder 16 and the driving means 18. Accordingly, the key cylinder 18 is rotated together with the driving means 18 through the latch means 19 with a proper key.

Figure 7:
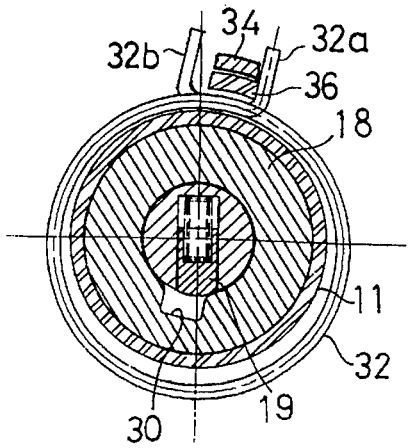
FIG. 7 is a cross-sectional view taken along line IV—IV of FIG. 5.

The clutch means 20 which is disposed in the slot 13*a* of the sleeve 13, includes a crescent body 20*a*, a pair of legs 24 radially extending from the crescent body 20*a*, a projection 20*b* radially extending from the crescent body 20*a* between these legs 24, a protrusion 25 axially extending from the crescent body 20*a*, and a convexity 26 radially protruding from the crescent body 20*a*. The clutch means 20 is resiliently pushed by a clutch spring 28 toward an inner wall of the first hole 12 of the housing 11 so that the convexity 26 is received within a groove 31 formed in the first hole 12. When the clutch means 20 is in the inoperative position of FIG. 2 during use of a proper key, the protrusion 25 is not in contact with the connector 23 of the latch means 19 elastically pushed by the latch spring 27, and therefore the key cylinder 16 is smoothly rotated with the proper key. Without rotation of the sleeve 13, the convexity 26 of the clutch means 20 is retained engaged with the groove 31 of the first hole 12. However, when an improper key is used, the sleeve 13 is rotated with the key cylinder 16 and the clutch means 20 to rotate the convexity 26 away from the groove 31, thus causing the radially inward movement of the clutch means 20 against resilient force of the clutch spring 28. Consequently, the protrusion 25 is moved radially inwardly to contact the connector 23 of the latch means 19 which is then radially inwardly moved against elastic force of the latch spring 27. At this time, the connector 23 of the latch means 19 moves into the enlarged hole 21*b* of the latch hole 21 to release the driving connection between the connector 23 and the driving means 18. By engagement of a pair of protrusions 35 formed on the driving means 18 with a pair of square holes 37 formed in lever 33, the lever 33 rotates together with the driving means 18. Operatively connected to a lock device (not shown) is the lever 33 which is rotatably supported on the end of the key cylinder 16 with the E-shaped ring 29. Disposed outside the housing 11 is a return spring 32 which has two ends 32*a*, 32*b* positioned to receive therebetween an outer protrusion 36 formed in the housing 11 and a bent stopper 34 formed in the lever 33 as shown in FIG. 7 for automatic returning the driving means 18 to the initial position after the driving means 18 is rotated.

As shown FIG. 1, the groove 31 terminates with an opening 11*b* in the front end of the housing 11 to drain water entering the housing 11 through the groove 31 and the opening 11*b*.

When a key is not inserted into the key cylinder 16, the tumblers 17 are engaged with the notch 15 of the sleeve 13 to connect the key cylinder 16 and the latch means 19 is in the joint position drivingly connecting the key cylinder 16 and the driving means 18 as shown in FIG. 3. When a proper key is inserted into a key hole 16*c* of the key cylinder 16, the tumblers 17 are moved into the retracted position within the key cylinder 16 to disengage the key cylinder 16 and the sleeve 13. With rotation of the key, the key cylinder 16 is rotated while the sleeve 13 is retained unturned in the condition wherein the convexity 26 of the clutch means 20 is urged in the groove 31 by the clutch spring 28. Then, the driving means 18 and the lever 33 can be rotated to the locked or unlocked position with the rotation of the key cylinder 16 in driving connection with the key cylinder 16 through the driving means 18 and the latch means 19 as shown in FIG. 3. When rotative force of the key is removed under the rotated condition of the key cylinder 16, the return spring 32 generates restorative force so that the lever 33, the driving means 18 and the key cylinder 16 are automatically returned to the initial position.

Figure 5:
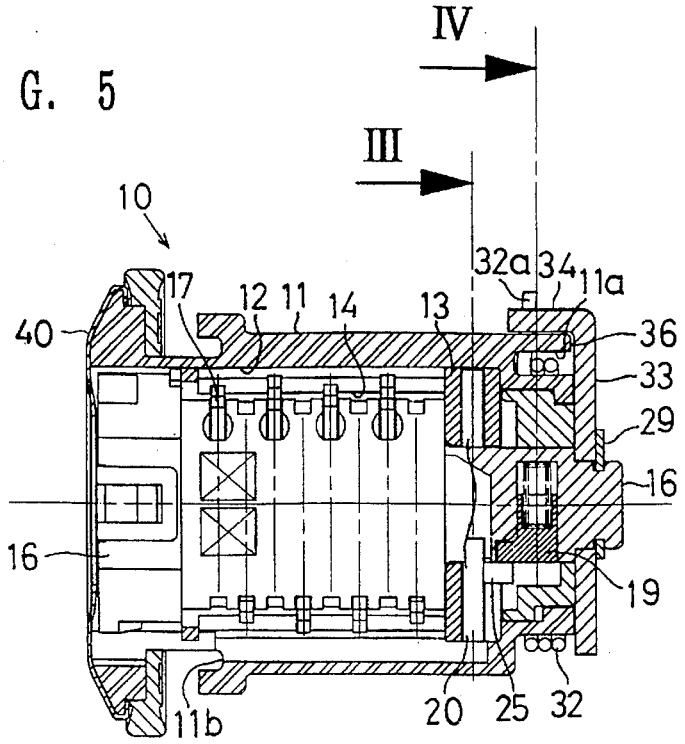
FIG. 5 is a longitudinal section view of the cylinder lock according to the present invention when an improper key is used.
Figure 6:
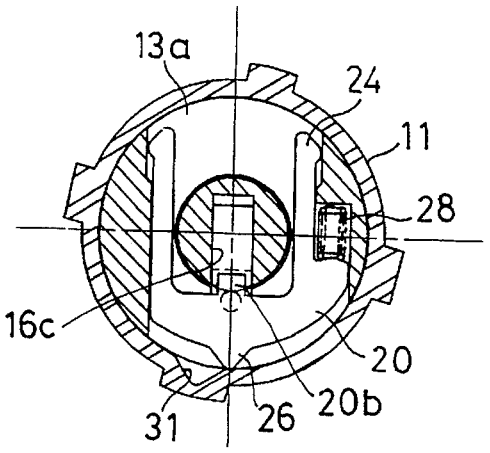
FIG. 6 is a cross-sectional view taken along line III—III of FIG. 5.

When an improper key is inserted into the key cylinder 16, as shown in FIG. 5, the tumblers 17 continues to project from the key cylinder 16 and still retains the engaged condition of the key cylinder 18 and the sleeve 13. Accordingly, the key cylinder 16 is rotated together with the sleeve 13 with rotation of the key. At the same time, the clutch means 20 is rotated with the sleeve 13 as shown in FIG. 6 so that the convexity 28 of the clutch means 20 is forcibly radially inwardly moved out of the groove 31 of the housing 11 against resilient force of the clutch spring 28 to rotate. Therefore, as shown in FIGS. 5 through 7, the latch means 19 is pushed inwardly to the release position into the latch hole 21 by the protrusion 25 of the clutch means 20 to disengage the latch means 19 and the driving means 18. In this stage, the projection **20*b* of the clutch means 20 is engaged with a groove 16*d* of the key cylinder 16 for integral rotation of the key cylinder 16 and clutch means 20. While the key cylinder 16 is rotated with the sleeve 13, the driving means 18 is maintained in the unturned condition due to the disengagement with the key cylinder 16 by the latch means 19, thus preventing rotation of the lever 33 to the locked or unlocked position. After that, when the key cylinder 16 is rotated with a proper key, the convexity 26 of the clutch means 20 is again engaged with the groove 31 of the housing 11 by integral rotation of the key cylinder 16 and sleeve 13** to return to the initial condition.

FIGS. 8 through 14 indicate a second embodiment of the present invention wherein each leg 24 of the clutch means 20 has a round notch **24*a* to receive the latch means 19. In this embodiment, the latch means 19 includes a connecting portion 41 radially extending and received within a slit 44 formed in the key cylinder 16; a column portion 42 connected with the connecting portion 41 and disposed in the round notches 24*a* of the legs 24; and a pair of lugs 43 axially protruding from the column portion 42. The driving means 18 has a shaft portion 45 having a rear end connected with a lock device (not shown); a flange portion 46 formed at the front end of the shaft 45; a pair of arcuate portions 47 projecting from the flange portion 46 to define a gap 48 between these arcuate portions 47**.

Figure 8:
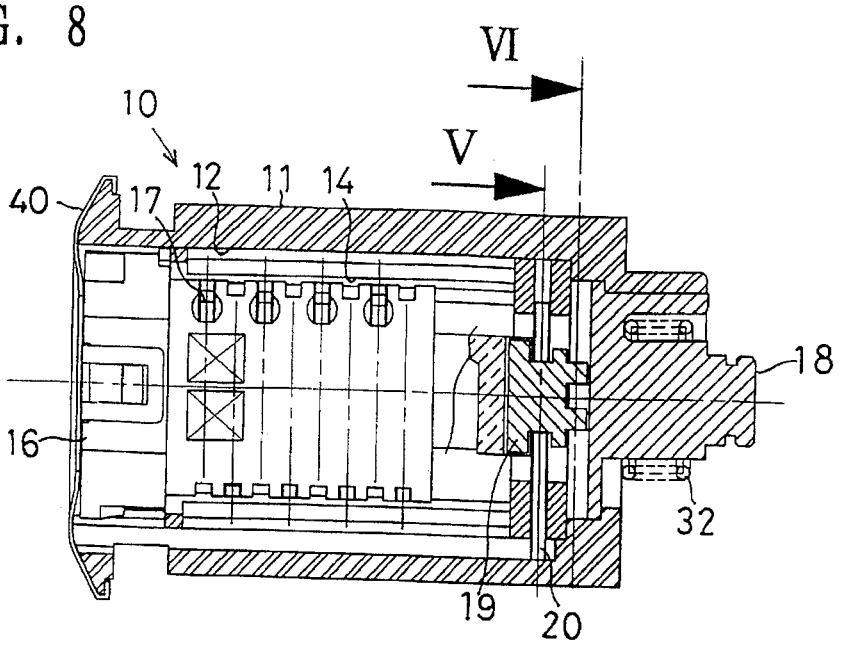
FIG. 8 is a longitudinal section view of a second embodiment of the cylinder lock according to the present invention.
Figure 9:
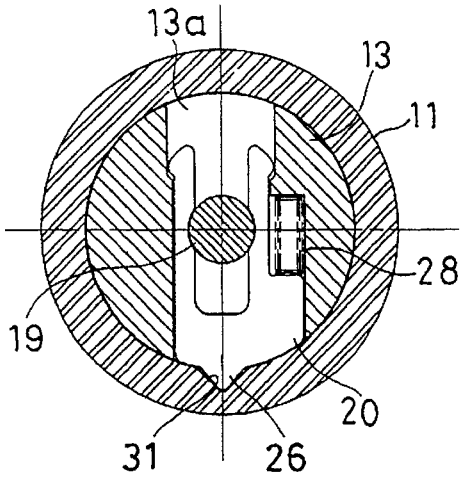
FIG. 9 is a cross-sectional view taken along line V—V of FIG. 8.
Figure 10:
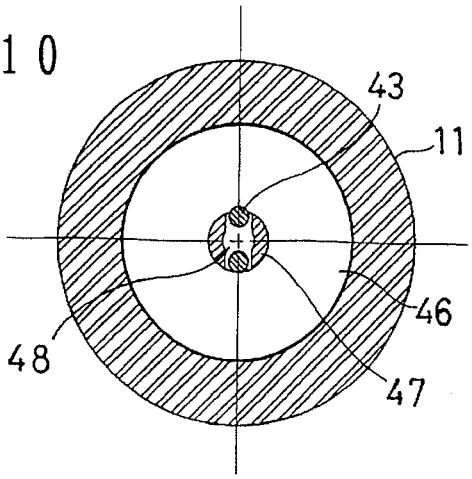
FIG. 10 is a cross-sectional view taken along line VI—VI of FIG. 8.
Figure 11:
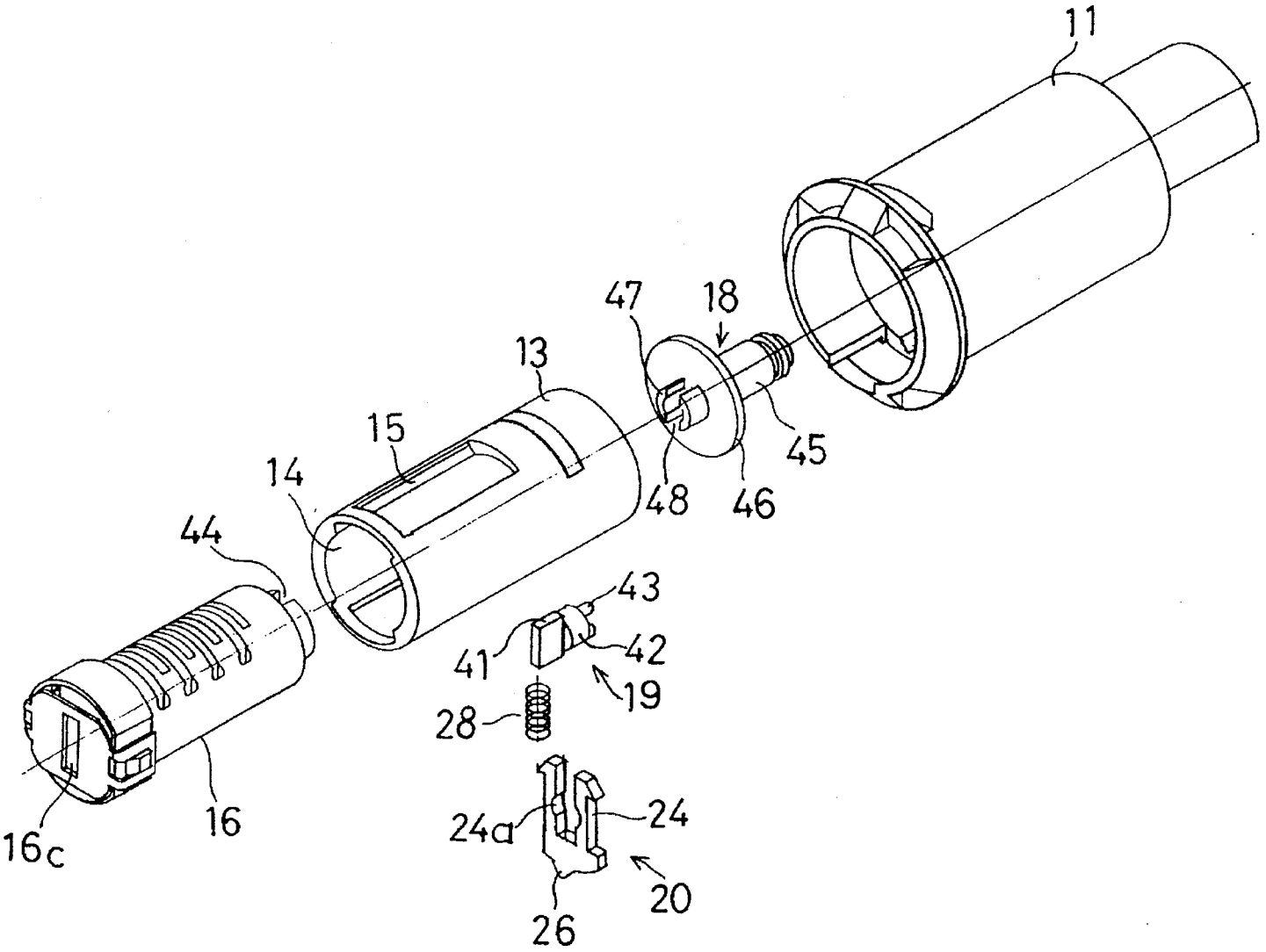
FIG. 11 is an exploded view of the second embodiment of the cylinder lock according to the present invention.

As shown in FIGS. 8 through 10, the clutch means 20 is disposed in the slot **13*a* of the sleeve 13 and elastically pushed by the clutch spring 28 toward the inner wall of the housing 11. When a proper key is inserted into the key cylinder 16, the tumblers 17 release the engagement between the key cylinder 16 and the sleeve 13. Upon rotation of the key, the key cylinder 16 is rotated while the sleeve 13 is kept in the engaged position shown in FIG. 9 and remains unturned due to the engagement of the convexity 26 and the groove 31. Accordingly, the latch means 19 is maintained in the joint position in alignment with the center of the sleeve 13 as illustrated in FIG. 9. With rotation of the key and the key cylinder 16, the latch means 19 is rotated so that as understood from FIG. 10, the lugs 43 of the latch means 19 contacts the arcuate portions 47 of the driving means 18 to transmit the rotation force to the driving means 18, thereby causing rotation of the driving means 18 to the locked or unlocked position. When the rotation force is removed from the key, the driving means 18 and the key cylinder 16 are automatically returned by the return spring 32** similarly to the foregoing operation.

Figure 12:
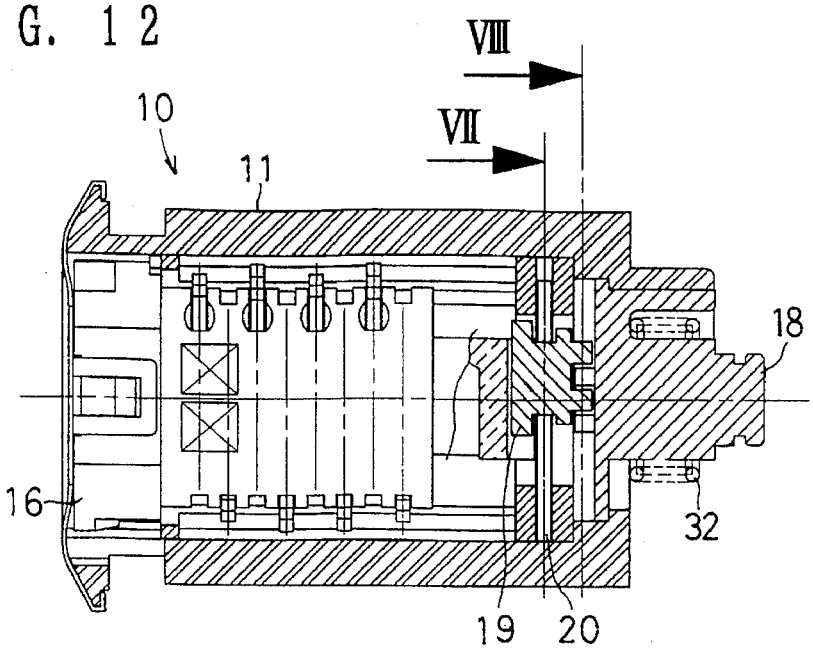
FIG. 12 is a longitudinal section view of the second embodiment of the cylinder lock according to the present invention when an improper key is used.
Figure 13:
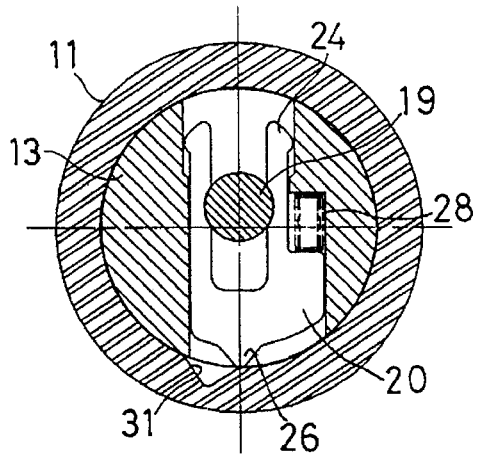
FIG. 13 is a cross-sectional view taken along line VII—VII of FIG. 12.
Figure 14:
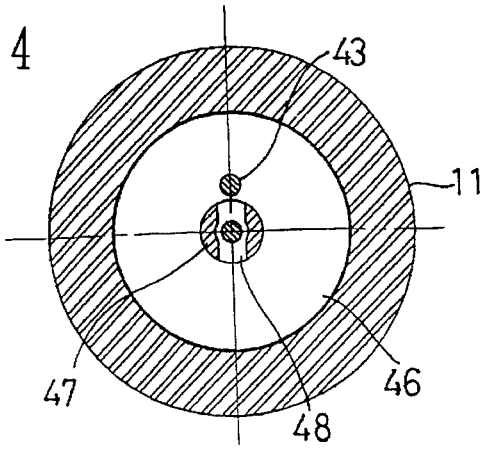
FIG. 14 is a cross-sectional view taken along line VIII—VIII of FIG. 12.
Figure 15:
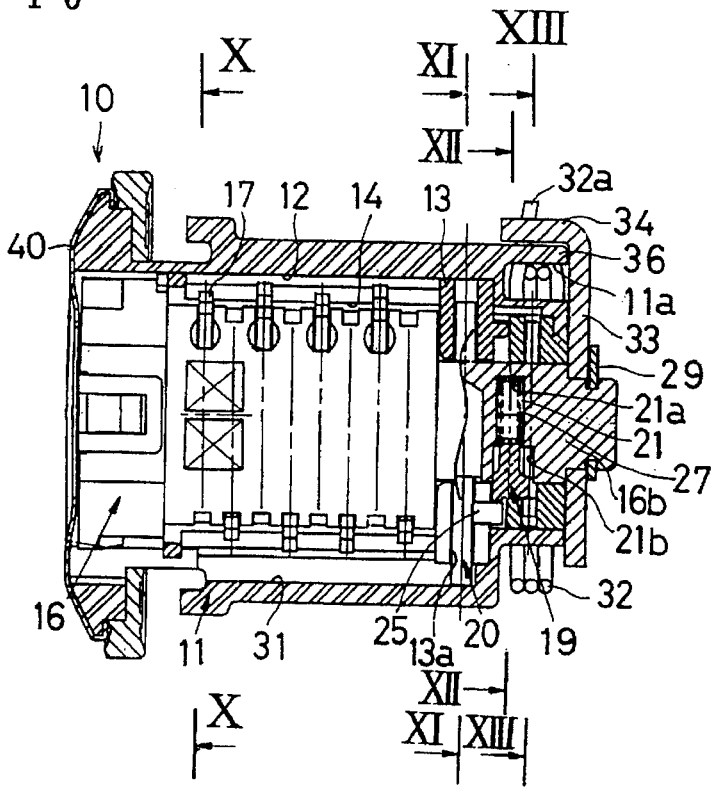
FIG. 15 is a cross-sectional view taken along line IX—IX of FIG. 16 indicating a third embodiment of the cylinder lock according to the present invention.
Figure 16:
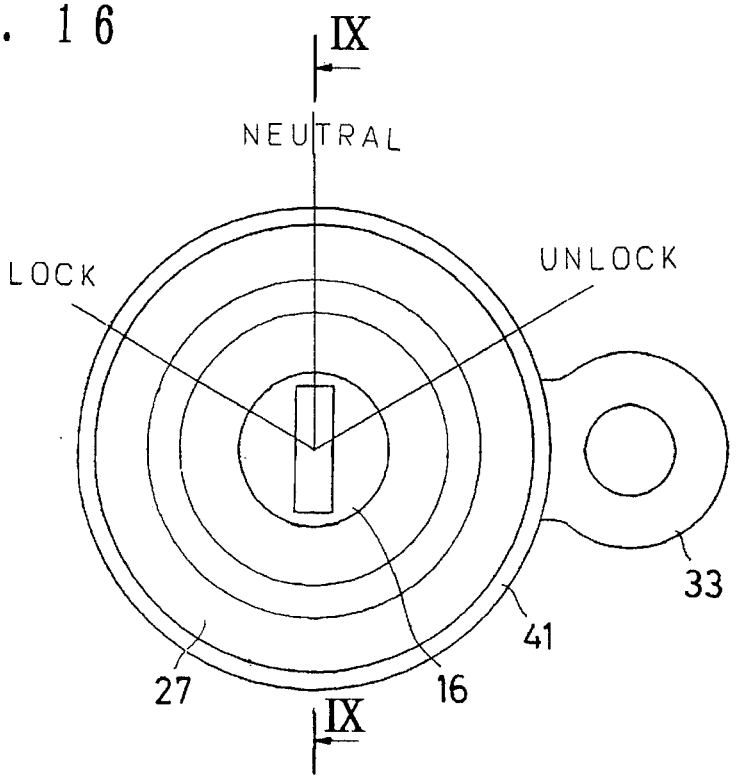
FIG. 16 is a front view of the third embodiment.
Figure 17:
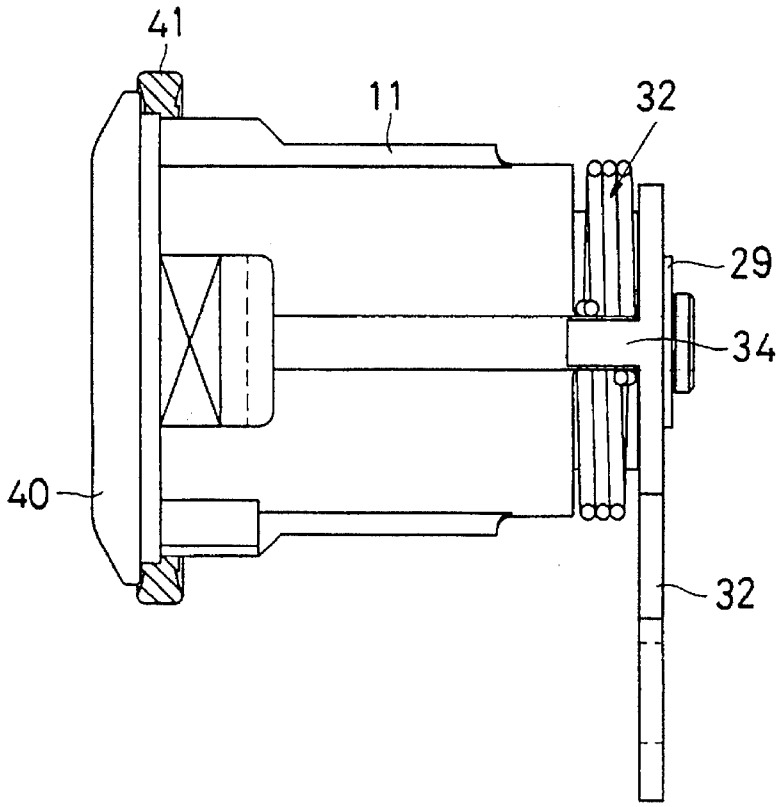
FIG. 17 is a side view of the third embodiment.
Figure 18:
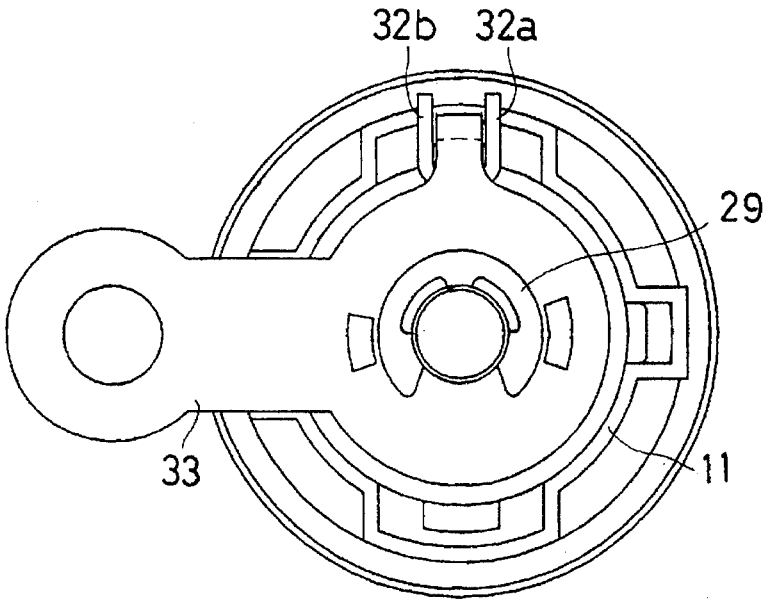
FIG. 18 is a rear view of the third embodiment.
Figure 19:
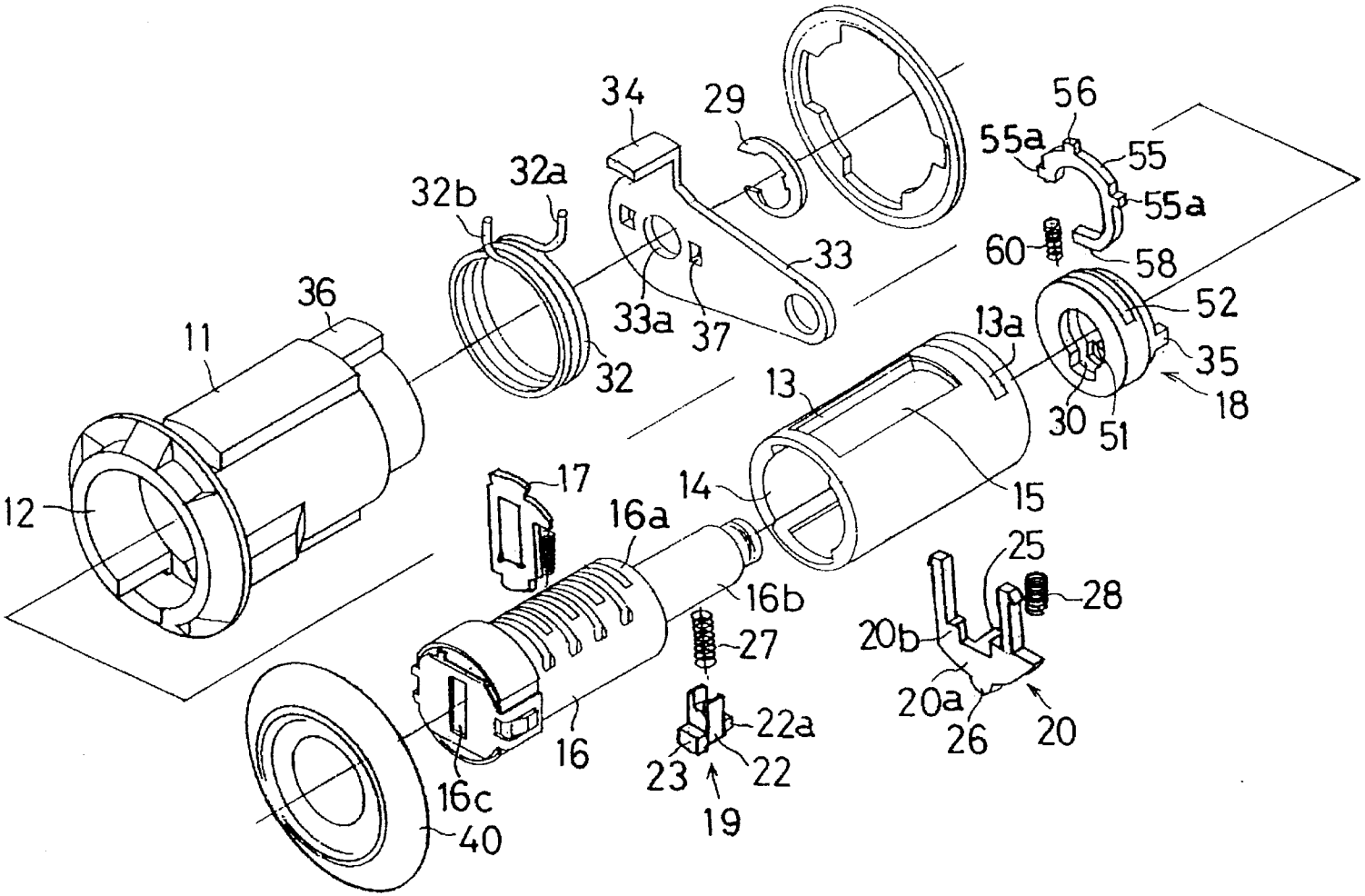
FIG. 19 is an exploded view of the third embodiment.
Figure 20:
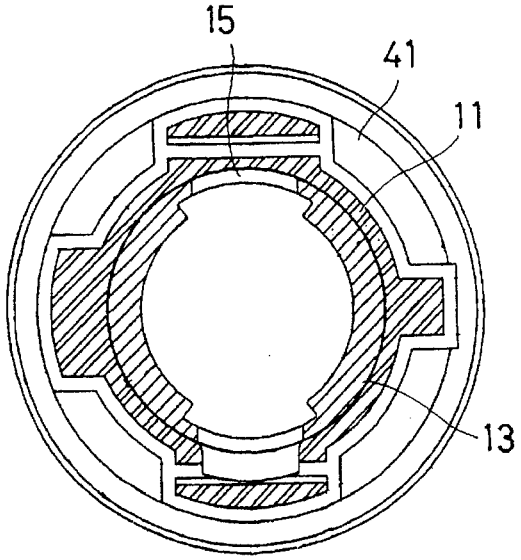
FIG. 20 is a cross-sectional view taken along line X—X of FIG. 15 with removal of the key cylinder.
Figure 21:
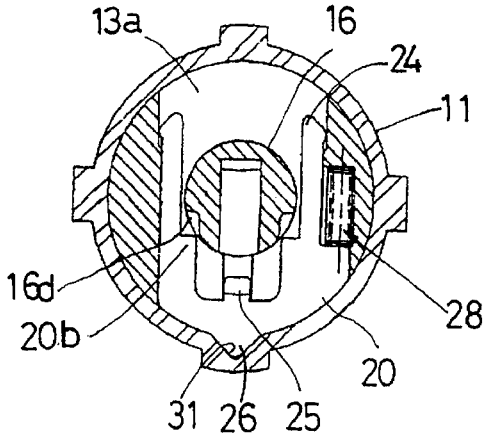
FIG. 21 is a cross-sectional view taken along line XI—XI of FIG. 15.

When an improper key is inserted into the key cylinder 16, as shown in FIGS. 12 through 14, the key cylinder 16 is kept engaged with the sleeve 13 through the tumblers 17, and accordingly, the key cylinder 16 rotates together with the sleeve 13 upon rotation of the key. As the clutch means 20 is rotated with the sleeve 13, the convexity 26 is forcibly moved out of the groove 31 of the housing 11 against resilient force of the clutch spring 28 as depicted in FIG. 13 so that the lugs 43 of the latch means 19 is radially moved away from the joint position in alignment with the center of the key cylinder 16 to the release position wherein the lugs 43 can not contact the arcuate portions 47 of the driver means 18 as exhibited in FIG. 14. Accordingly, the lever 33 can not be rotated to the locked or unlocked position by rotation of the key cylinder 16 because the driving means 18 is maintained unturned.

Figure 22:
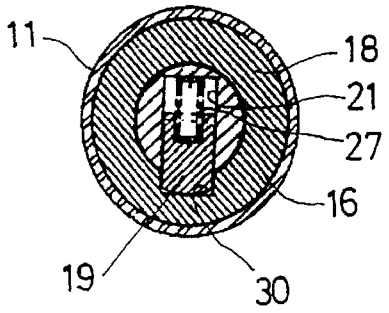
FIG. 22 is a cross-sectional view taken along line XII—XII of FIG. 15.
Figure 23:
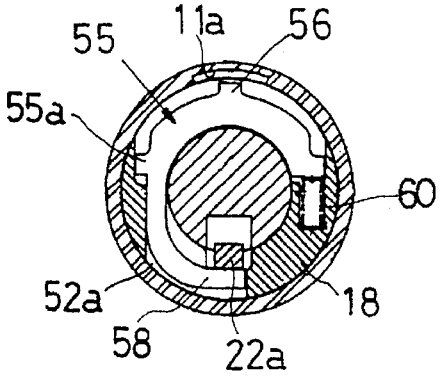
FIG. 23 is a cross-sectional view taken along line XIII—XIII of FIG. 15.
Figure 24:
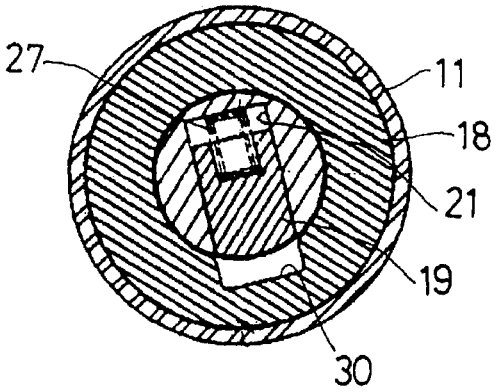
FIG. 24 is a cross-sectional view taken along line XII—XII of FIG. 15 in use of an improper key.
Figure 25:
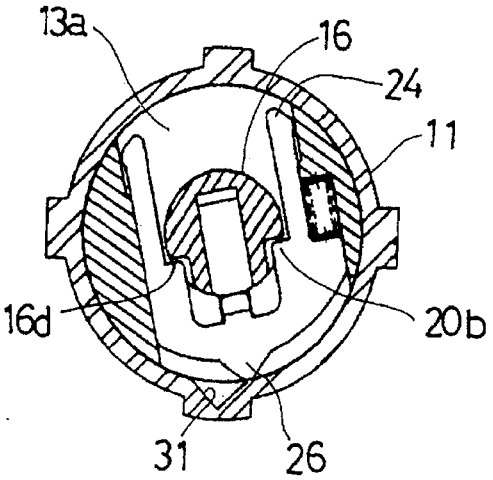
FIG. 25 is a cross-sectional view taken along line XI—XI of FIG. 15 in use of an improper key.
Figure 26:
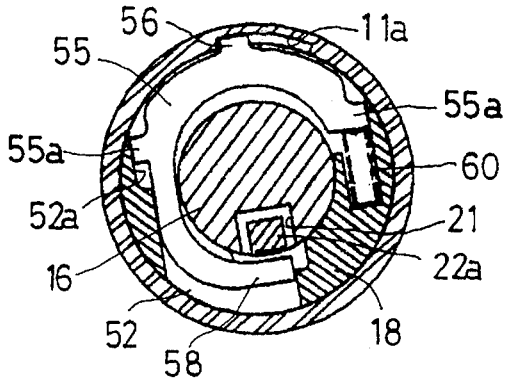
FIG. 26 is a cross-sectional view taken along line XIII—XIII of FIG. 15 in use of an improper key.
Figure 27:
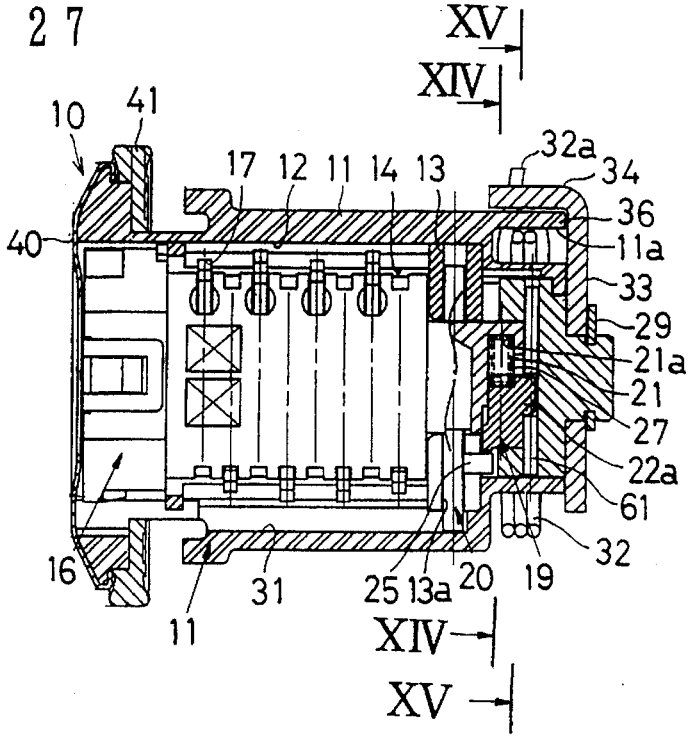
FIG. 27 is a cross-sectional view of a fourth embodiment according to the present invention.
Figure 29:
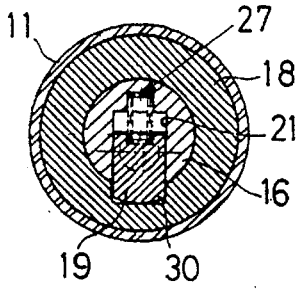
FIG. 29 is a cross-sectional view taken along line IVX—IVX of FIG. 27.
Figure 28:
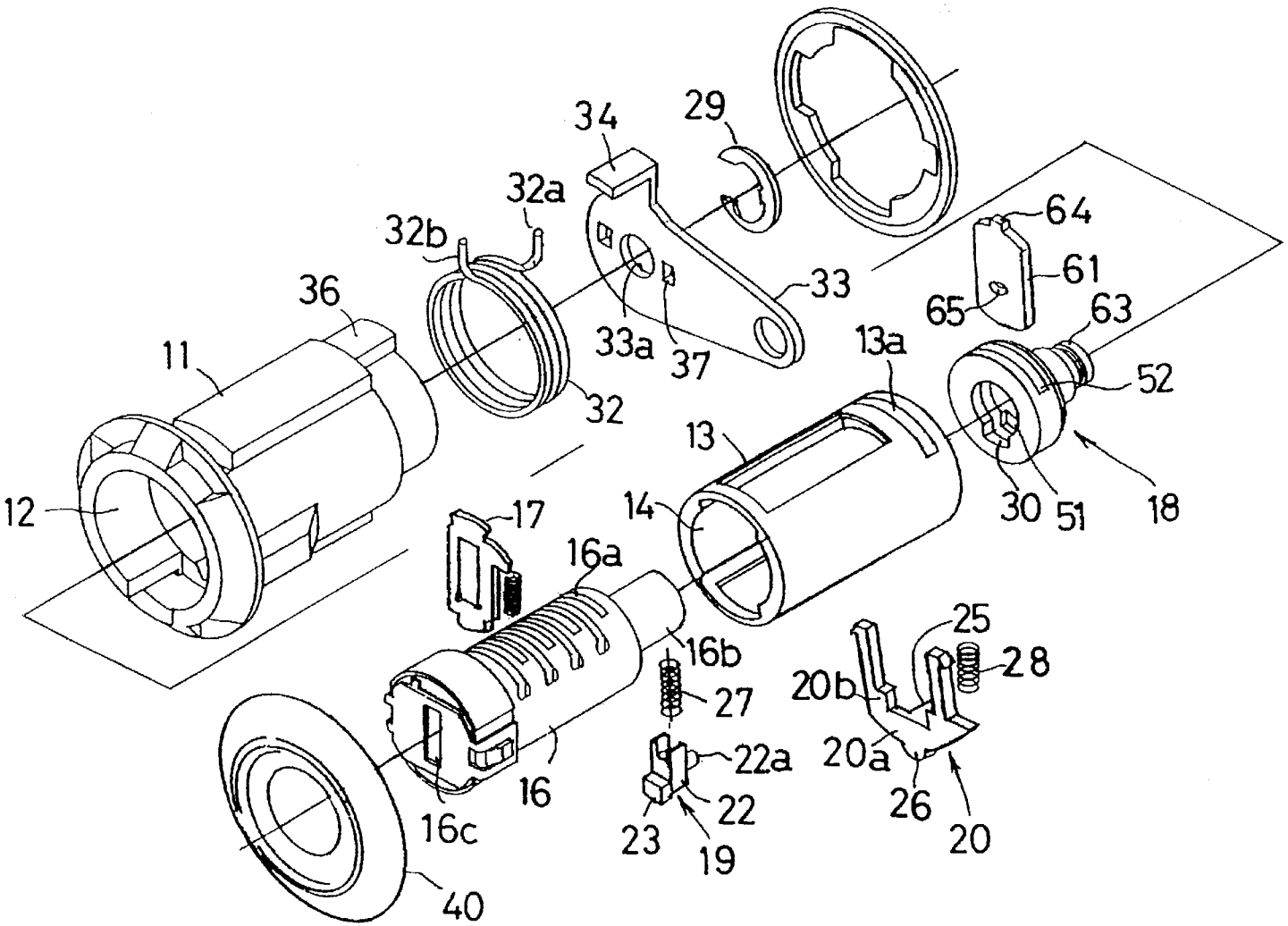
FIG. 28 is an exploded view of the fourth embodiment.
Figure 30:
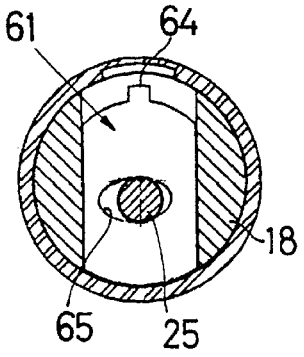
FIG. 30 is a cross-sectional view taken along line VX—VX of FIG. 27.
Figure 31:
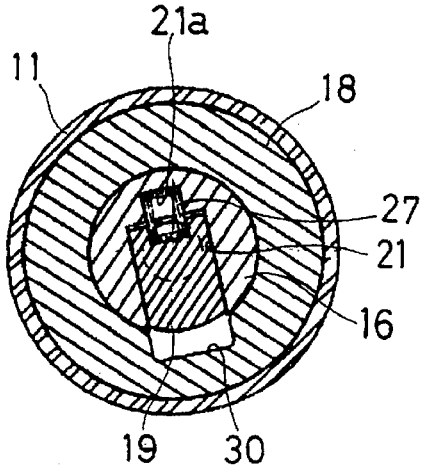
FIG. 31 is a cross-sectional view taken along line IVX—IVX of FIG. 27 in use of an improper key.
Figure 32:
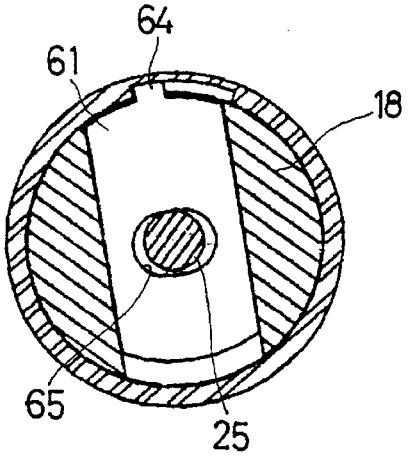
FIG. 32 is a cross-sectional view taken along line VX—VX of FIG. 27 in use of an improper key.

In the third embodiment according to the present invention shown in FIGS. 15 to 26, the driving means 18 comprises an axial cylindrical hole 51 for receiving the cylindrical portion **16*b* of the key cylinder 16; a radial slit 52 and an axial groove 30 both communicating the cylindrical hole 51; and a pair of protrusions 35 axially extending. Locking means 55 is slidably disposed in the slit 52. As shown in FIG. 23, the locking means 55 is formed generally into C-shape which comprises a protrusion 56 which can be engaged with a depression 11*a* formed in the housing 11; a pair of guide projections 55*a* slidably mounted in guide notches 52*a* which are formed in communication with the slit 52; and a hook portion 58 provided at a diametrically opposite side of the protrusion 56 so that the hook portion 58 may contact an axially extending lug 22*a* formed in the latch means 19. The guide projections 55*a* are outwardly urged by a locking spring 60 positioned in the driving means 18 so that the hook portion 58 is in contact with the lug 22*a* unless the lug 22*a* is moved into the latch hole 21 of the cylindrical portion 16*b* of the key cylinder 16. The locking means 55 can be moved between the latched position of FIG. 26 wherein the protrusion 56 is engaged with the depression 11*a* of the housing 11 and the unlatched position of FIG. 23 wherein the protrusion 56 is disengaged from the depression 11*a* of the housing 11 in response to the movement of the latch means 19 between the joint position of FIG. 22 and the release position of FIG. 24. Accordingly, the locking spring 60 pushes the locking means 55 toward the latched position. As shown in FIG. 23, the locking means 55 is maintained in the unlatched position by the lug 22*a* of the latch means 19 in the joint position against the elastic force of the locking spring 60. When the latch means 19 is moved to the release position of FIG. 26 by radial inward movement of the clutch means 20, the locking means 55 is moved to the latched position by elastic force of the locking spring 60 so that the protrusion 56 is engaged with the depression 11*a*. To this end, the latch spring 27 produces its elastic force stronger than that of the locking spring 60 while the latch means 19 is urged toward the recess 30 of the driving means 18 by the latch spring 27 positioned within the latch hole 21 of the key cylinder 16**.

In operation, when the key cylinder 16 is rotated with a proper key, the driving means 18 can be rotated by the latch means 19 of FIG. 22 which drivingly connects the key cylinder 16 and the driving means 18. Adversely, when the key cylinder 16 is rotated with an improper key, the sleeve 13 is rotated with the key cylinder 18 so that the clutch means 20 is moved from the unturned position of FIG. 21 to the turned position of FIG. 25. Accordingly, the latch means 19 is inwardly moved from the joint position of FIGS. 15 and 22 to the release position of FIG. 24, and hence a pair of protrusions 20*b* of the clutch means 20 are brought into engagement with a pair of notches 16*d* of the key cylinder 16. Consequently, the latch means 19 is moved away from the recess 30 of the driving means 18 and the locking means 55 is moved from the unlatched position of FIG. 23 to the latched position of FIG. 26 so that the protrusion 56 is engaged with the depression 11*a* of the housing 11 to secure the driving means 18 to the housing 11, while the key cylinder 16 is disengaged from the driving means 18 in operation. The radial movement of the locking means 55 is effective to produce the lock in shorter size.

FIGS. 27 to 32 demonstrates a fourth embodiment of the present invention wherein locking means 61 is slidably mounted within the radial slit 52 of the driving means 18. An end 63 of the drive means 18 is rigidly positioned in an opening 33*a* of the lever 33. The locking means 61 is provided with a connecting hole 65 for receiving the lug 22*a* of the latch means 19, and a protrusion 64 engageable with the depression 11*a* of the housing 11. When the locking means 61 is moved to the latched position wherein the protrusion 64 is in engagement with the depression 11*a* in use of a improper key, the lug 22*a* of the latch means 19 and the connecting hole 65 are retained in alignment with the central axis of the key cylinder 16 so that the lug 22*a* can be rotated in the connecting hole 65.

Modes of the present invention are not limited to the embodiment described above, and may be modified in various ways. For instance, instead of the lever 33, an electric switch may be provided to generate electric signals upon rotation of the driving means 18. Pin tumblers are also utilized in place of the disk tumblers 17. The latch spring 27 for the latch means 19 can resiliently urge the clutch means 20 without the clutch spring 28.

As described above, the present invention provides a cylinder lock remarkably resistible against its destruction to effectively prevent such crimes as unauthorized intrusion and thieves. In addition, the cylinder lock according to the instant invention has excellent durability and operability without parts axially moved when a proper key is inserted and initially rotated because the key cylinder is usually in driving connection with the driver means. This means that no additional means is required to drivingly connect the key cylinder and the driving means during the initial rotation of the key cylinder. Accordingly, the invention's cylinder lock can be assembled with less number of sliding parts and with shorter whole length of the lock, reducing breakdown and prolonging its service life. Furthermore, the cylinder lock does not require the mechanically stronger structure at the front portion . . . pa

What is claimed is:

1. A cylinder lock comprising a housing having a first hole;

a sleeve rotatably disposed within said first hole of said housing and having a second hole and a notch;

a key cylinder rotatably disposed within said second hole of said sleeve;

tumblers slidably disposed in said key cylinder for engagement with and disengagement from said notch of said sleeve;

driving means provided relatively rotatable to said housing;

latch means movable between a joint position for connecting said key cylinder and said driving means and a release position for disengaging the key cylinder and driving means;

clutch means radially movably disposed in said sleeve for conveying said latch means to the release position when said sleeve is moved relative to said housing; and a clutch spring for resiliently urging said clutch means toward said housing;

said housing being formed with a groove which receives a convexity formed in said clutch means, said convexity of said clutch means being moved away from said groove of said housing for disengaging said latch means and said driving means with movement of said clutch means when said sleeve is rotated relative to said housing.

2. The cylinder lock of claim 1, wherein said latch means is generally formed into L-shape which comprises a spring holder and a connector; said spring holder is urged toward said driving means by a latch spring disposed in said key cylinder; and said clutch means has a protrusion which axially extends not to contact said latch means when a proper key is inserted into a key hole of the key cylinder.

3. The cylinder lock of claim 1, wherein said latch means is generally formed into L-shape which comprises a spring holder and a connector; said spring holder is urged toward said driving means by a latch spring disposed in said key cylinder; and said clutch means has a protrusion which axially extends to contact said latch means when an improper key is inserted into a key hole of the key cylinder.

4. The cylinder lock of claim 1, wherein said latch means includes a connecting portion disposed within a radial slit formed in said key cylinder for integral rotation; a column portion coupled with said connecting portion for engagement with said clutch means; and a pair of lugs axially extending from said column portion; said driving means includes a shaft portion; a flange portion formed at an end of said shaft portion; and a pair of arcuate portions axially projecting with a gap formed between said arcuate portions; wherein said lugs are engaged with and disengaged from said arcuate portions with radial movement of said clutch means.

5. The cylinder lock of claim 1, wherein said clutch means has a radially extending projection which may be engaged with said key cylinder when an improper key is used, said convexity of said clutch means is received in said groove of said housing in position when said key cylinder is rotated later with a proper key.

6. The cylinder lock of claim 1, wherein said groove of said housing axially extends and reaches an opening formed in said housing to drain water entering said housing through said groove and said opening.

7. A cylinder lock comprising a housing having a first hole; a sleeve rotatably disposed within said first hole of said housing and having a second hole and a notch; a key cylinder rotatably disposed within said second hole of said sleeve; tumblers slidably disposed in said key cylinder for engagement with and disengagement from said notch of said sleeve; driving means provided relatively rotatable to said housing and key cylinder; latch means movable between a joint position for connecting said key cylinder and said driving means and a release position for disengaging the key cylinder and driving means; clutch means radially movably disposed in said sleeve for conveying said latch means to the release position when said sleeve is moved relative to said housing; and a clutch spring for resiliently urging said clutch means toward said housing;

said housing being formed with a groove which receives a convexity formed in said clutch means, said convexity of said clutch means being moved away from said groove of said housing for disengaging said latch means and said driving means with movement of said clutch means when said sleeve is rotated relative to said housing;

locking means having a protrusion which can be engaged with a depression formed in said housing, said locking means being movable between a latched position wherein said protrusion is engaged with said depression of the housing and an unlatched position wherein said protrusion is disengaged from said depression of the housing;

said locking means being moved between the latched and unlatched positions in response to movement of said latch means between the joint and release positions.

8. The cylinder lock of claim 7, further comprising a locking spring for resiliently urging said locking means toward the latched position, said locking means being retained in the unlatched position against elastic force of said locking spring by said latch means in the joint position, said locking means being moved to the latched position by elastic force of said locking spring.

9. The cylinder lock of claim 8, wherein said locking means has a hook portion which is in contact with a lug of said latch means, the latch spring produces its resilient force stronger than that of said locking spring; said latch means is urged toward said driving means by said latch spring positioned within said key cylinder.

10. The cylinder lock of claim 7, wherein said locking means is slidably disposed within a slit formed in said driving means, said locking means in the latched position secures said driving means to said housing when said latch means is moved by said clutch means, thereby causing rotation of the key cylinder, sleeve and latch means without rotation of said driving means.

11. The cylinder lock of claim 7, wherein said latch means is urged by said latch spring positioned within said key cylinder toward said driving means, said clutch means has a projection which axially extends to contact with said latch means when said key cylinder is rotated with an improper key.

12. The cylinder lock of claim 7, wherein said locking means is in driving connection with said latch means, said locking means is slidably mounted within a radial recess.

13. The cylinder lock of claim 12, wherein said locking means has a connecting hole for receiving a lug of said latch means, the lug of said latch means and connecting hole of said locking means are positioned in a central line of said key cylinder so that the lug can be relatively rotated within said connecting hole when said locking means is in the latched position.

14. The cylinder lock of claim 7, wherein said clutch means has a radially extending projection which may be engaged with said key cylinder, when an improper key is used, said convexity of said clutch means is received in said groove of said housing in position when said key cylinder is rotated later with a proper key.

15. The cylinder lock of claim 7, wherein said groove of said housing axially extends and reaches an opening formed in said housing to drain water entering said housing through said groove and said opening.

* * * * *